US008252352B2

(12) United States Patent
Aldridge

(10) Patent No.: US 8,252,352 B2
(45) Date of Patent: Aug. 28, 2012

(54) GUM SLAB PACKAGE WITH FLAP RETENTION

(75) Inventor: Allen Sydney Aldridge, South Orange, NJ (US)

(73) Assignee: Kraft Foods Global Brands LLC, Northfield, IL (US)

( * ) Notice: Subject to any disclaimer, the term of this patent is extended or adjusted under 35 U.S.C. 154(b) by 12 days.

(21) Appl. No.: 13/039,435

(22) Filed: Mar. 3, 2011

(65) Prior Publication Data

US 2011/0151050 A1 Jun. 23, 2011

Related U.S. Application Data

(63) Continuation of application No. 11/124,921, filed on May 9, 2005, now Pat. No. 7,901,719.

(60) Provisional application No. 60/569,833, filed on May 11, 2004, provisional application No. 60/570,018, filed on May 11, 2004, provisional application No. 60/570,128, filed on May 11, 2004.

(51) Int. Cl.
*B65D 81/32* (2006.01)

(52) U.S. Cl. ..... 426/115; 426/108; 426/119; 426/5; 206/265; 206/271; 206/449; 206/472; 206/474; 206/784; 206/800; 229/103.2

(58) Field of Classification Search ..... 426/5, 115, 426/119, 108; 206/271, 449, 460, 472, 473, 206/474, 784, 800; 229/103.2, 120.1, 120.2
See application file for complete search history.

(56) References Cited

U.S. PATENT DOCUMENTS

| | | | |
|---|---|---|---|
| 183,466 | A | 10/1876 | Pearl |
| 202,210 | A | 4/1878 | Zerban |
| 271,580 | A | 1/1883 | Jones |
| 276,171 | A | 4/1883 | Fraser |
| 329,134 | A | 10/1885 | Brotz |
| 528,186 | A | 10/1894 | Strakosch |
| 603,872 | A | 5/1898 | Bucklin |
| 624,583 | A | 5/1899 | Vierengel |
| 656,349 | A | 8/1900 | Hilson |
| 732,844 | A | 7/1903 | Gerbereux |
| 924,275 | A | 6/1909 | Richardson |
| 1,037,218 | A | 9/1912 | Dirnberger |
| 1,096,909 | A | 5/1914 | Harvey |

(Continued)

FOREIGN PATENT DOCUMENTS

| | | |
|---|---|---|
| BE | 417615 | 10/1936 |

(Continued)

OTHER PUBLICATIONS

Mr. Brown Chewing Gum, Product Description, p. 1, http://www.gnpd.com, Feb. 7, 2000.
Third Party Observations, European Patent Office, Application No. 05768974.7, 11 pages, Dec. 15, 2009.
Notice of Opposition, European Patent Office, Application No. 05748373.7, 24 pages, Apr. 7, 2010.
U.S. Appl. No. 60/560,306, filed Apr. 6, 2004, 47 pages. (to which a claim of priority is made in 7,527,189; 2005/0218198; 2007/0134371; 2007/0138035; and 2007/0141199.

* cited by examiner

*Primary Examiner* — Rena Dye
*Assistant Examiner* — Chaim Smith
(74) *Attorney, Agent, or Firm* — Hoffmann & Baron, LLP

(57) ABSTRACT

A package assembly encloses a plurality of individual elongate consumable products. The package assembly includes a plurality of products aligned in a side-by-side array. A package housing encloses the array of products. The package housing has front and back walls for supporting the products therebetween in a closable cover for closing a product dispensing opening. The front wall includes a wall flap extending inwardly towards the back wall in frictional engagement with the array of products for removable retention of the products therein.

2 Claims, 4 Drawing Sheets

U.S. PATENT DOCUMENTS

| | | | |
|---|---|---|---|
| 1,132,781 | A | 3/1915 | Lile |
| 1,144,559 | A | 6/1915 | Mendelson et al. |
| 1,193,423 | A | 8/1916 | Pryor |
| 1,216,259 | A | 2/1917 | Armstrong |
| 1,253,219 | A | 1/1918 | Dula |
| 1,275,904 | A | 8/1918 | Grotta |
| 1,320,287 | A | 10/1919 | Stern |
| 1,382,459 | A | 6/1921 | Bercovici |
| 1,432,932 | A | 10/1922 | Weis |
| 1,433,439 | A | 10/1922 | Weis |
| 1,469,080 | A | 9/1923 | Goerk |
| 1,490,529 | A | 4/1924 | Dittgen |
| 1,550,966 | A | 8/1925 | Kappes |
| 1,575,420 | A | 3/1926 | Eisenstark et al. |
| 1,625,651 | A | 4/1927 | Gretsch |
| 1,683,651 | A | 9/1928 | Bovard |
| 1,684,381 | A | 9/1928 | Bahr |
| 1,735,325 | A | 11/1929 | L'enfant |
| 1,751,208 | A | 3/1930 | Kappes |
| 1,755,579 | A | 4/1930 | Grupe |
| 1,763,763 | A | 6/1930 | Denmead |
| 1,805,417 | A | 5/1931 | Ritzel |
| 1,805,418 | A | 5/1931 | Ritzel |
| 1,806,905 | A | 5/1931 | Kampfman |
| 1,800,000 | A | 9/1931 | Molins |
| 1,854,849 | A | 4/1932 | Lerch |
| 1,863,190 | A | 6/1932 | Coulapides |
| 1,864,493 | A | 6/1932 | Bombard et al. |
| 1,865,535 | A | 7/1932 | Meany |
| 1,870,299 | A | 8/1932 | Strelitz |
| 1,871,426 | A | 8/1932 | Schmitt |
| 1,875,197 | A | 8/1932 | Molins |
| 1,895,233 | A | 1/1933 | Rossen |
| 1,906,742 | A | 5/1933 | Coulapides |
| 1,929,148 | A | 10/1933 | Molins et al. |
| 2,008,168 | A | 7/1935 | Bergstein |
| 2,008,361 | A | 7/1935 | Lindsey |
| 2,031,011 | A | 2/1936 | Solon |
| 2,032,661 | A | 3/1936 | Linker |
| 2,039,491 | A | 5/1936 | Nolan |
| 2,042,073 | A | 5/1936 | Rose |
| 2,049,124 | A | 7/1936 | Linderman |
| 2,074,451 | A | 3/1937 | Berberian |
| 2,085,728 | A | 7/1937 | Clark |
| 2,117,281 | A | 5/1938 | Bravi |
| 2,118,849 | A | 5/1938 | Lindsey |
| 2,128,843 | A | 8/1938 | Mullins |
| 2,140,748 | A | 12/1938 | Johanson |
| 2,158,971 | A | 5/1939 | Stratton |
| 2,165,539 | A | 7/1939 | Dahlgren |
| 2,192,472 | A | 3/1940 | Huston |
| 2,192,473 | A | 3/1940 | Huston |
| 2,197,219 | A | 4/1940 | Gorshong |
| 2,933,182 | A | 4/1940 | Davis |
| 2,201,956 | A | 5/1940 | Little |
| 2,208,229 | A | 7/1940 | Ranney |
| 2,210,194 | A | 8/1940 | Baldwin |
| 2,210,195 | A | 8/1940 | Baldwin |
| 2,210,196 | A | 8/1940 | Baldwin |
| 2,212,773 | A | 8/1940 | Gray |
| 2,251,102 | A | 7/1941 | Atterberg |
| 2,258,716 | A | 10/1941 | Ralph et al. |
| 2,263,191 | A | 11/1941 | Saladin et al. |
| 2,268,379 | A | 12/1941 | Bird et al. |
| 2,276,577 | A | 3/1942 | Hahn |
| 2,277,097 | A | 3/1942 | Hansen |
| 2,298,028 | A | 10/1942 | Bazley |
| 2,327,301 | A | 8/1943 | Davis |
| 2,343,222 | A | 2/1944 | Nelson |
| 2,379,934 | A | 7/1945 | Sieferth |
| 2,380,367 | A | 7/1945 | Ranney |
| 2,470,388 | A | 5/1949 | Ball |
| 2,547,779 | A | 4/1951 | Renyck |
| 2,563,689 | A | 8/1951 | Muhlhauser |
| 2,578,583 | A | 12/1951 | O'Brien |
| 2,605,897 | A | 8/1952 | Rundle |
| 2,619,092 | A | 11/1952 | Ayers |
| 2,619,226 | A | 11/1952 | Adams |
| 2,682,475 | A | 6/1954 | Smith |
| 2,719,663 | A | 10/1955 | Meyer-Jagenberg |
| 2,744,624 | A | 5/1956 | Hoogstoel et al. |
| 2,755,918 | A | 7/1956 | Gargagliano |
| 2,799,441 | A | 7/1957 | Nerney |
| 2,801,002 | A | 7/1957 | Volckening et al. |
| 2,803,376 | A | 8/1957 | Kampff |
| 2,812,057 | A | 11/1957 | Brownfield |
| 2,820,545 | A | 1/1958 | Bramhill |
| 2,823,798 | A | 2/1958 | Volckening et al. |
| 2,858,060 | A | 10/1958 | Kuchler |
| 2,871,080 | A | 1/1959 | Shelly |
| 2,883,045 | A | 4/1959 | Abramson |
| 2,923,110 | A | 2/1960 | Tamarin |
| 2,954,116 | A | 9/1960 | Maso et al. |
| 2,962,161 | A | 11/1960 | Lacy |
| 2,980,240 | A | 4/1961 | Amatel |
| 2,988,209 | A | 6/1961 | Parrilla |
| 3,002,674 | A | 10/1961 | Wright |
| 3,027,998 | A | 4/1962 | Ridgway |
| 3,035,756 | A | 5/1962 | Mullinix |
| 3,047,144 | A | 7/1962 | Wissel |
| 3,069,003 | A | 12/1962 | Amatel |
| 3,071,244 | A | 1/1963 | Doran |
| 3,092,501 | A | 6/1963 | Beck et al. |
| 3,108,711 | A | 10/1963 | Anton |
| 3,113,673 | A | 12/1963 | Stein |
| 3,118,588 | A | 1/1964 | Noble |
| 3,152,694 | A | 10/1964 | Nashed et al. |
| 3,165,249 | A | 1/1965 | Peck |
| 3,187,889 | A | 6/1965 | Sinclair |
| 3,201,258 | A | 8/1965 | Mastella |
| 3,201,536 | A | 8/1965 | Fisher et al. |
| 3,204,759 | A | 9/1965 | Palmer |
| 3,206,094 | A | 9/1965 | Humphrey et al. |
| 3,224,922 | A | 12/1965 | Fry, Jr. |
| 3,272,423 | A | 9/1966 | Bjarno |
| 3,282,413 | A | 11/1966 | Sparks |
| 3,322,323 | A | 5/1967 | Greene et al. |
| 3,323,643 | A | 6/1967 | Rush |
| 3,367,552 | A | 2/1968 | Krzyanowski |
| 3,374,884 | A | 3/1968 | Chinkes |
| 3,389,784 | A | 6/1968 | Hendricks et al. |
| 3,389,852 | A | 6/1968 | Egli |
| 3,438,565 | A | 4/1969 | Lugt et al. |
| 3,509,989 | A | 5/1970 | Woll |
| 3,524,583 | A | 8/1970 | Gregory |
| 3,542,191 | A | 11/1970 | Scott |
| 3,580,466 | A | 5/1971 | Thelen |
| 3,583,358 | A | 6/1971 | Hanson, Jr. |
| 3,591,071 | A | 7/1971 | Rosenburg, Jr. |
| 3,623,653 | A | 11/1971 | Work |
| 3,642,564 | A | 2/1972 | Walker et al. |
| 3,664,572 | A | 5/1972 | Puchkoff et al. |
| 3,708,946 | A | 1/1973 | Cahill |
| 3,732,663 | A | 5/1973 | Geldmacher |
| 3,734,280 | A | 5/1973 | Amneus et al. |
| 3,734,801 | A | 5/1973 | Sebel |
| 3,756,385 | A | 9/1973 | Steinbock |
| 3,835,989 | A | 9/1974 | Mori et al. |
| 3,881,649 | A | 5/1975 | Krautsack |
| 3,923,239 | A | 12/1975 | Lee |
| 3,924,739 | A | 12/1975 | Gravesteijn |
| 3,938,655 | A | 2/1976 | Romolt |
| 3,966,045 | A | 6/1976 | Perdue |
| 3,991,168 | A | 11/1976 | Richards et al. |
| 4,015,770 | A | 4/1977 | Tamarin |
| 4,053,049 | A | 10/1977 | Beauvais |
| 4,101,024 | A | 7/1978 | Furuya et al. |
| 4,119,196 | A | 10/1978 | Flaherty |
| 4,125,189 | A | 11/1978 | Fujimoto et al. |
| 4,131,195 | A | 12/1978 | Worrell, Sr. |
| D250,748 | S | 1/1979 | Leger |
| 4,142,635 | A | 3/1979 | Capo et al. |
| 4,192,420 | A | 3/1980 | Worrell, Sr. et al. |
| 4,197,949 | A | 4/1980 | Carlsson |
| 4,216,898 | A | 8/1980 | Davies |
| 4,234,084 | A | 11/1980 | Hutten |
| 4,260,061 | A | 4/1981 | Jacobs |

| | | | |
|---|---|---|---|
| RE30,616 | E | 5/1981 | Hofer |
| 4,294,353 | A | 10/1981 | Focke et al. |
| 4,360,106 | A | 11/1982 | Irvine et al. |
| 4,377,235 | A | 3/1983 | Carver |
| 4,411,365 | A | 10/1983 | Horikawa et al. |
| 4,436,205 | A | 3/1984 | Horii |
| 4,441,611 | A | 4/1984 | Sommariva |
| 4,464,154 | A | 8/1984 | Ljungcrantz |
| 4,470,508 | A | 9/1984 | Yen |
| 4,546,875 | A | 10/1985 | Zweber |
| 4,552,269 | A | 11/1985 | Chang |
| 4,610,357 | A | 9/1986 | Nakamura |
| 4,637,544 | A | 1/1987 | Quercetti |
| 4,658,963 | A | 4/1987 | Jud |
| 4,666,040 | A | 5/1987 | Murata |
| 4,679,693 | A | 7/1987 | Forman |
| 4,738,359 | A | 4/1988 | Phillips, Jr. |
| 4,850,482 | A | 7/1989 | Campbell |
| 4,874,096 | A | 10/1989 | Tessera-Chiesa |
| 4,902,142 | A | 2/1990 | Lammert et al. |
| 4,912,910 | A | 4/1990 | Lowe et al. |
| 4,949,841 | A | 8/1990 | Focke et al. |
| 4,961,496 | A | 10/1990 | Focke et al. |
| 4,997,082 | A | 3/1991 | Durocher |
| 5,029,712 | A | 7/1991 | O'Brien et al. |
| 5,078,509 | A | 1/1992 | Center et al. |
| 5,080,227 | A | 1/1992 | Focke |
| 5,092,465 | A | 3/1992 | Weder et al. |
| 5,096,113 | A | 3/1992 | Focke |
| 5,123,589 | A | 6/1992 | Cote |
| 5,125,211 | A | 6/1992 | O'Brien et al. |
| 5,128,157 | A | 7/1992 | Ruiz |
| 5,145,091 | A | 9/1992 | Meyers |
| 5,150,720 | A | 9/1992 | Focke et al. |
| 5,192,386 | A | 3/1993 | Moir et al. |
| 5,195,637 | A | 3/1993 | Weder |
| 5,215,249 | A | 6/1993 | Gorrieri |
| 5,240,109 | A | 8/1993 | Weder et al. |
| 5,255,784 | A | 10/1993 | Weder et al. |
| 5,290,616 | A | 3/1994 | Cowan et al. |
| 5,301,804 | A | 4/1994 | Focke et al. |
| 5,307,988 | A | 5/1994 | Focke et al. |
| 5,311,992 | A | 5/1994 | Weder et al. |
| 5,316,211 | A | 5/1994 | Chang |
| 5,344,008 | A | 9/1994 | DeBlasio et al. |
| D351,104 | S | 10/1994 | Kapp |
| 5,358,171 | A | 10/1994 | Focke |
| 5,407,072 | A | 4/1995 | Weder et al. |
| 5,427,235 | A | 6/1995 | Powell et al. |
| 5,435,439 | A | 7/1995 | Swart |
| 5,462,223 | A | 10/1995 | Focke et al. |
| D365,023 | S | 12/1995 | Abrams et al. |
| 5,489,060 | A | 2/1996 | Godard |
| 5,510,124 | A | 4/1996 | Kopecky et al. |
| 5,511,658 | A | 4/1996 | Focke et al. |
| 5,515,965 | A | 5/1996 | Boldrini et al. |
| 5,522,205 | A | 6/1996 | Weder |
| 5,553,773 | A | 9/1996 | Focke et al. |
| 5,556,026 | A | 9/1996 | Blankitny |
| 5,560,482 | A | 10/1996 | Katagiri et al. |
| 5,575,385 | A | 11/1996 | Zona |
| 5,607,056 | A | 3/1997 | Whiteside |
| 5,620,550 | A | 4/1997 | Andersson et al. |
| 5,632,378 | A | 5/1997 | Provost |
| 5,636,732 | A | 6/1997 | Gilels et al. |
| 5,732,823 | A | 3/1998 | Weder et al. |
| 5,738,207 | A | 4/1998 | Trimani |
| 5,783,266 | A | 7/1998 | Gehrke |
| 5,797,494 | A | 8/1998 | Balling et al. |
| 5,819,925 | A | 10/1998 | Brizzi et al. |
| 5,823,331 | A | 10/1998 | Manservigi et al. |
| 5,836,448 | A | 11/1998 | Weder |
| 5,855,434 | A | 1/1999 | Hagen |
| 5,860,524 | A | 1/1999 | Weder |
| 5,860,526 | A | 1/1999 | Burke, Jr. |
| 5,878,883 | A | 3/1999 | Weder |
| 5,924,571 | A | 7/1999 | Cornelissen |
| 5,941,641 | A | 8/1999 | Kinigakis et al. |
| 5,944,188 | A | 8/1999 | Grosskopf et al. |
| 5,992,621 | A | 11/1999 | Grant et al. |
| 5,996,797 | A | 12/1999 | Flaig |
| 6,001,397 | A | 12/1999 | Boyd et al. |
| 6,010,724 | A | 1/2000 | Boyd et al. |
| 6,026,953 | A | 2/2000 | Nakamura et al. |
| D421,568 | S | 3/2000 | Ferguson et al. |
| 6,044,848 | A | 4/2000 | Huang |
| 6,094,917 | A | 8/2000 | Sundhar et al. |
| 6,105,856 | A | 8/2000 | Kakiuchi |
| 6,164,444 | A | 12/2000 | Bray et al. |
| 6,199,687 | B1 | 3/2001 | Tambo et al. |
| 6,202,838 | B1 | 3/2001 | Tran |
| 6,220,430 | B1 | 4/2001 | Boriani et al. |
| 6,228,450 | B1 | 5/2001 | Pedrini |
| 6,237,760 | B1 | 5/2001 | Parker et al. |
| 6,309,105 | B1 | 10/2001 | Palumbo |
| 6,334,532 | B1 | 1/2002 | Tambo et al. |
| 6,395,317 | B1 | 5/2002 | Singh et al. |
| D465,416 | S | 11/2002 | Dzwill et al. |
| 6,478,149 | B1 | 11/2002 | Parker |
| 6,505,735 | B1 | 1/2003 | Parker |
| D471,804 | S | 3/2003 | Staples |
| D479,464 | S | 9/2003 | Kopecky |
| D479,646 | S | 9/2003 | Overton |
| 6,644,488 | B1 | 11/2003 | Coleman |
| D484,046 | S | 12/2003 | Kopecky |
| 6,672,035 | B1 | 1/2004 | Simonsen et al. |
| 6,709,684 | B2 | 3/2004 | Loth |
| 7,032,754 | B2 | 4/2006 | Kopecky |
| 7,159,717 | B2 | 1/2007 | Aldridge et al. |
| 7,175,022 | B2 | 2/2007 | Ito |
| 7,467,711 | B2 | 12/2008 | Tambo |
| 7,527,189 | B2 | 5/2009 | Billig et al. |
| 7,533,773 | B2 | 5/2009 | Aldridge et al. |
| 8,016,105 | B2 | 9/2011 | Sendo |
| 2002/0063079 | A1 | 5/2002 | Loth |
| 2003/0034255 | A1 | 2/2003 | Luton et al. |
| 2003/0047470 | A1 | 3/2003 | Parker |
| 2003/0080020 | A1 | 5/2003 | Kopecky |
| 2003/0106928 | A1 | 6/2003 | Li Vigni et al. |
| 2005/0218198 | A1 | 10/2005 | Cavero et al. |
| 2005/0276525 | A1 | 12/2005 | Hebert et al. |
| 2006/0027483 | A1 | 2/2006 | Aldridge |
| 2007/0134371 | A1 | 6/2007 | Billig et al. |
| 2007/0138035 | A1 | 6/2007 | Fluegel et al. |
| 2007/0141199 | A1 | 6/2007 | Ishikawa et al. |

FOREIGN PATENT DOCUMENTS

| | | |
|---|---|---|
| CN | 1331646 | 1/2002 |
| DE | 653242 | 11/1937 |
| DE | 9405638 | 6/1994 |
| DE | 10238905 | 3/2004 |
| EP | 0 801 000 | 10/1997 |
| EP | 1367005 | 12/2003 |
| EP | 1591027 | 11/2005 |
| EP | 1595807 | 11/2005 |
| FR | 762011 | 9/1933 |
| FR | 1204079 | 10/1958 |
| GB | 461794 | 2/1937 |
| GB | 808056 | 1/1959 |
| GB | 2 074 532 | 11/1981 |
| GB | 2078202 | 1/1982 |
| GB | 2227221 | 7/1990 |
| GB | 2 258 634 | * 2/1993 |
| JP | 2-138584 | 11/1990 |
| JP | 07-099891 | 4/1995 |
| JP | 09-110072 | 4/1997 |
| JP | 3022304 | 12/1997 |
| JP | 11-1221 | 1/1999 |
| JP | 11-001220 | 6/1999 |
| JP | 11-227830 | 8/1999 |
| JP | 11-301648 | 11/1999 |
| WO | 00/12407 | 3/2000 |
| WO | 01/07335 | 2/2001 |
| WO | 03/037744 | 5/2003 |
| WO | 2008051813 | 5/2008 |

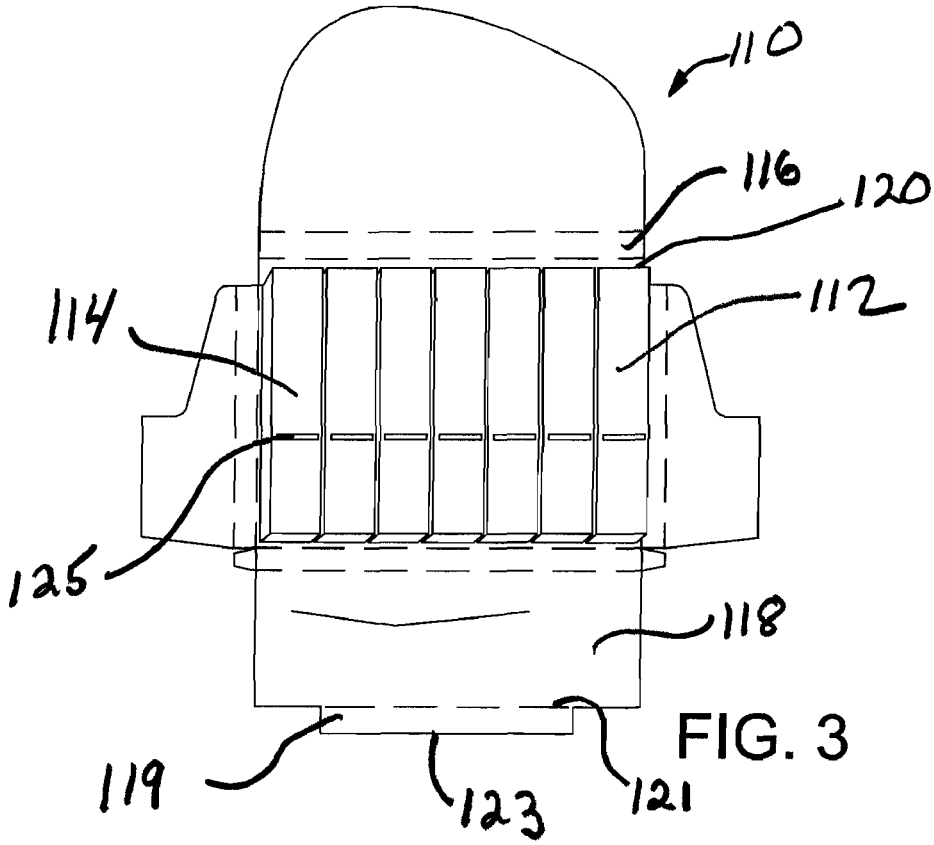
FIG. 3
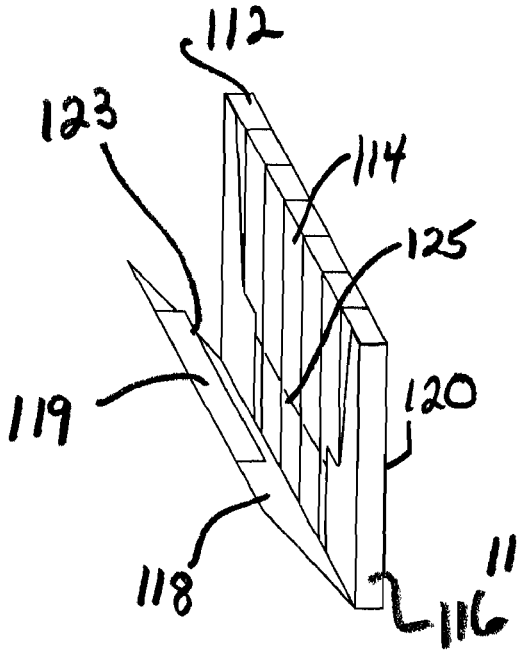
FIG. 4
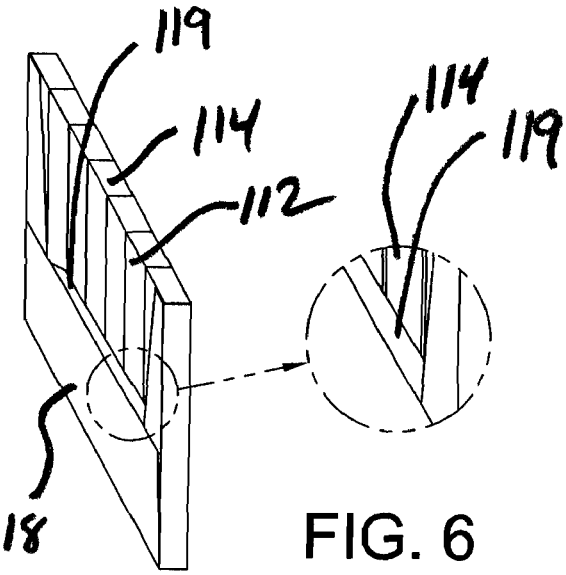
FIG. 5
FIG. 6

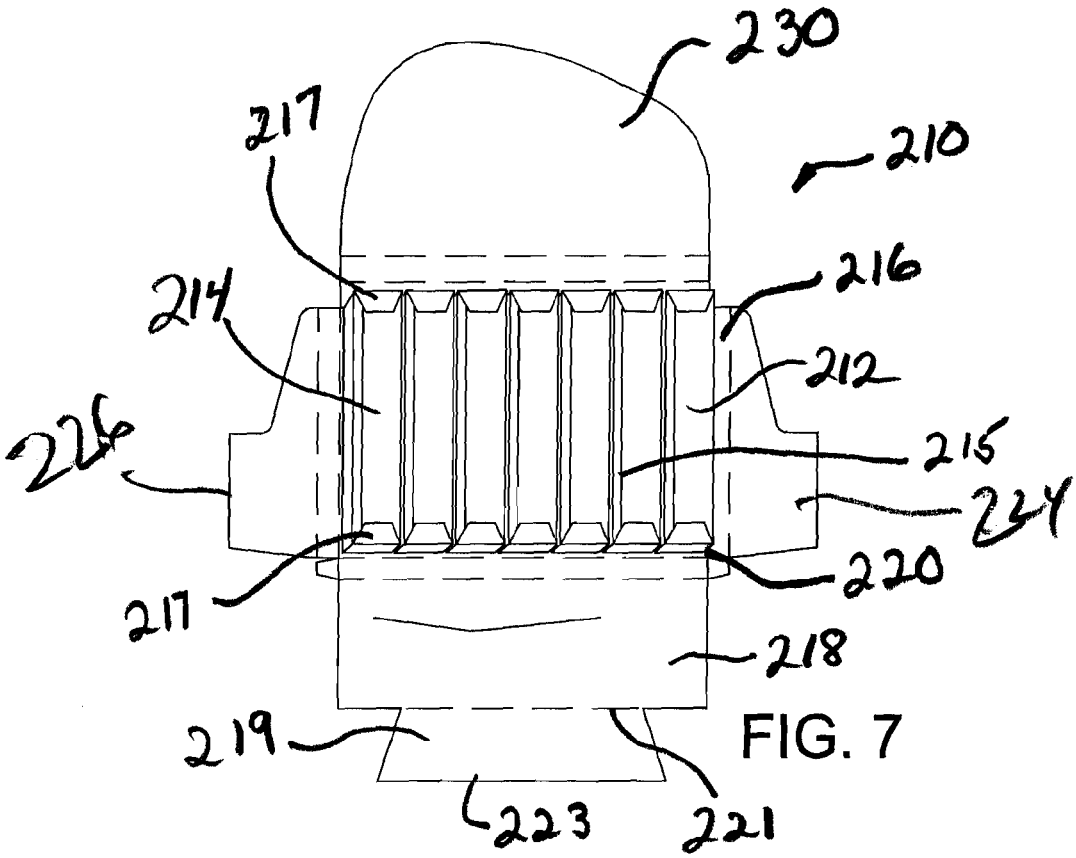
FIG. 7
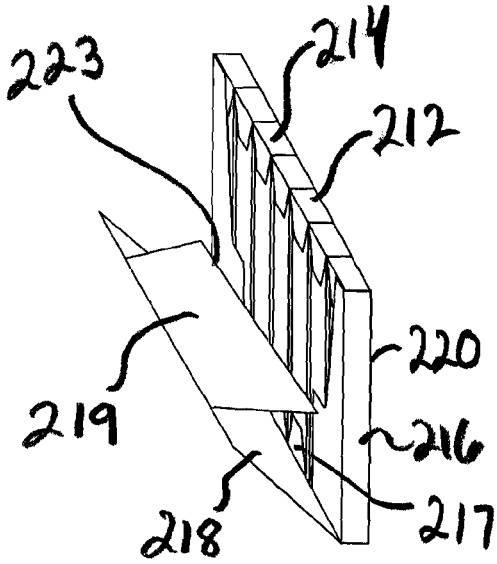
FIG. 8
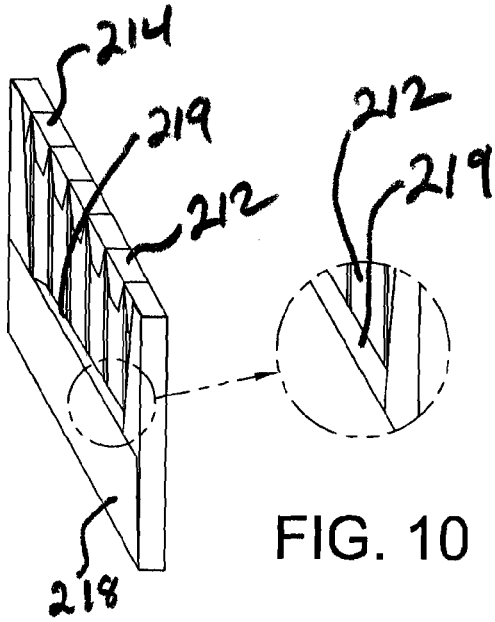
FIG. 9
FIG. 10

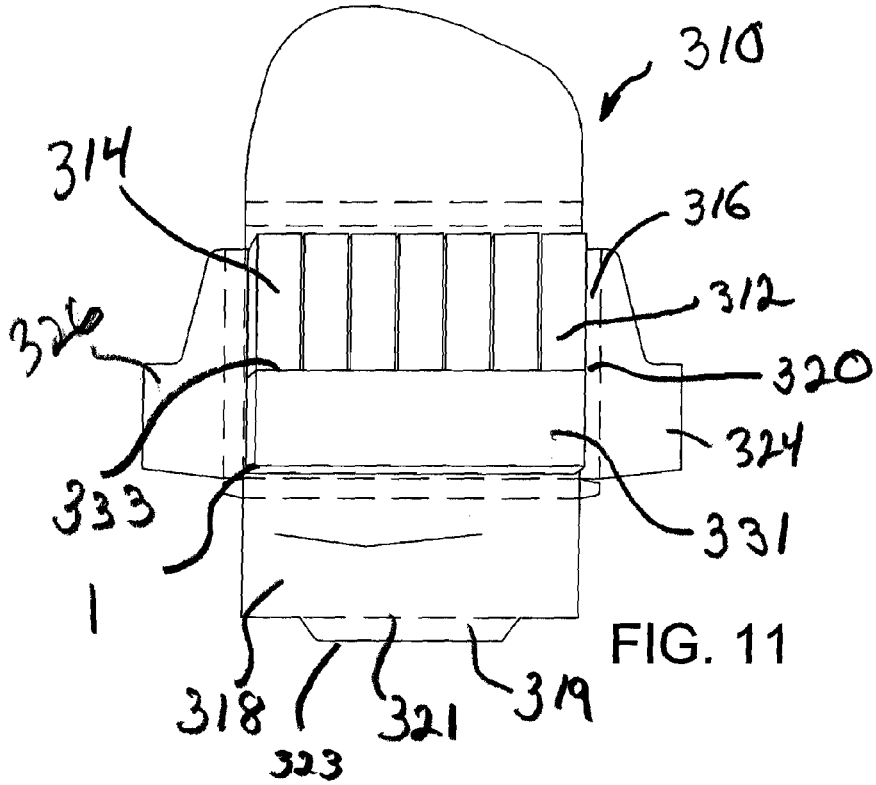
FIG. 11
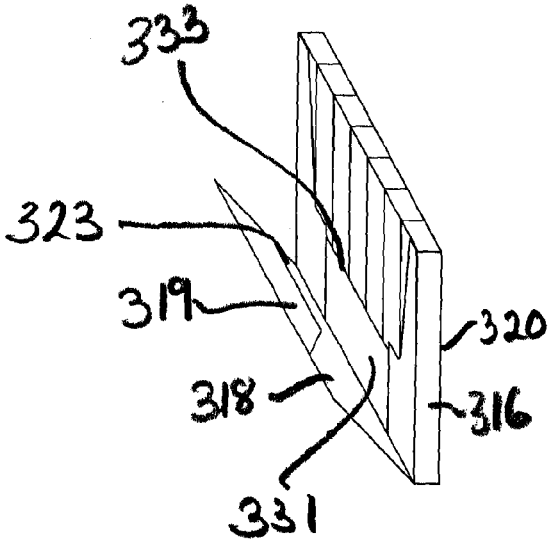
FIG. 12
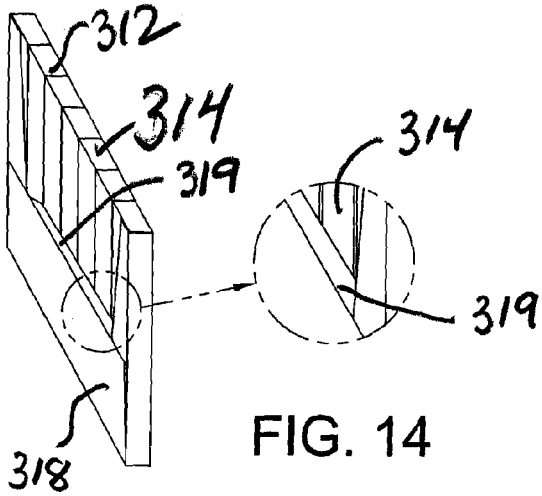
FIG. 13
FIG. 14

GUM SLAB PACKAGE WITH FLAP RETENTION

CROSS-REFERENCE TO RELATED APPLICATIONS

This application is a continuation of U.S. application Ser. No. 11/124,921, filed May 9, 2005, which claims priority to U.S. Provisional Application No. 60/569,833, filed May 11, 2004; U.S. Provisional Application No. 60/570,018, filed May 11, 2004; and U.S. Provisional Application No. 60/570,128, filed May 11, 2004; which are incorporated herein by reference.

FIELD OF THE INVENTION

The present invention relates generally to a package for containing an array of consumable products and retaining the products in the package until such time as it is desired to dispense the individual products. More particularly, the present invention relates to a package for retaining and dispensing gum slabs using a flap on the front wall.

BACKGROUND OF THE INVENTION

It is well known to house consumable products such as gum slabs in a package or housing which retains the gum slabs and allows for dispensing of an individual slab therefrom. The gum slabs are typically arranged in an array, so that a single gum slab may be removed from the array leaving the remaining gum slabs in the package. Often, the gum slabs may be wrapped individually in an outer wrapper.

Certain of the gum slab packages are of the type which maintain their outer configuration even after removal of one of the gum slabs. This creates a space in the package which allows adjacent gum slabs to become displaced. Therefore, it may become difficult to remove additional gum slabs from the package if one or more of the remaining gum slabs tilts or falls over within the package. Also, by creating such a space, the remaining gum slabs may slide or move in the package and may even fall out of the package.

One attempt to retain and dispense individual gum slabs from a package is shown in U.S. Patent Application Publication No. 2003/0080020 to Kopecky, the disclosure of which is incorporated by reference herein for all purposes. The Kopecky publication discloses a gum slab package housing formed from a die cut paperboard blank having a generally rectangular configuration. The housing includes a front cover which opens to expose a plurality of gum slabs. The gum slabs are contained in a side-by-side array by a sheet which wraps around the gum slabs. The sheet, including the gum slab array, is placed into the package housing such that the gum slabs are exposed once the front cover is opened. In order to retain the gum slabs in an upright condition and maintain the gum slabs within the package once one or more of the slabs are removed from the array, the gum slabs are adhesively secured to the sheet. The adhesive securement may take the form of wax areas on the inner surface of the sheet. Once the wrapped slabs are inserted into the sheet, heat is applied to the sheet to cause the wax to melt. The array of gum slabs secured to the sheet may then be placed in the package for retention and dispensing.

While the device disclosed in the Kopecky publication attempts to provide a package which allows for both the retention and dispensing of gum slabs, it has been found that the package may not adequately perform over the long term. Accordingly, it is desirable to provide an improved gum slab package which allows for the retention and dispensing of individual gum slabs and which will retain the remaining gum slabs in the package once one or more of the gum slabs are removed.

SUMMARY OF THE INVENTION

The present invention provides a package assembly for housing individual enlongate consumable products such as gum slabs. A plurality of consumable products are aligned in a side-by-side array. A package housing is provided for enclosing the array of products. The package housing includes a front and back wall for supporting the products therebetween. The package housing also has a closable cover for closing a product dispensing opening. The front wall includes a wall flap extending inwardly towards the back wall for frictional engagement with the array of products for removable retention of the products therein.

In one preferred embodiment of the present invention, the wall flap is folded so that a distal edge of the wall flap is engagable across the array of products providing removable frictional retention. Furthermore, the array of products may include a transversely scored groove thereacross. The distal edge of the flap is engagable within the groove for providing additional retentive engagement.

In a further preferred embodiment, each product of the array may be wrapped with a product wrapper. The wrapper is folded at least one end to define an upwardly turned wrapper flap facing the wall flap. The wrapper flap is engagable with the wall flap upon removal of the products from the housing so as to provide releasable retentive support of the products in the housing. The wrapped product is removed by deflecting the wrapper flap upon removal.

In a still further preferred embodiment, the assembly may include a band wrapped transversely around the array of products. The band supports the products within the package housing. The band includes a transverse edge extending across the product array. The wall flap is engagable with the band over the transverse edge to retain the band within the housing. The products may be releaseably retained within the band by an adhesive.

Still further, the band may be formed in the shape of a U-shaped pouch.

BRIEF DESCRIPTION OF THE DRAWINGS

FIG. 3 shows one embodiment of the present invention where the array of products is positioned within a package housing shown in its preassembled condition.

FIGS. 4, 5 and 6 show further details of the embodiment of FIG. 3 for retaining the array of products within the package housing.

FIG. 7 shows a further embodiment of the present invention where an array of individually wrapped products are supported within a package housing shown in its preassembled condition.

FIGS. 8, 9 and 10 show further details of the assembly of FIG. 7 for retaining the array of wrapped products.

FIG. 11 shows a still further embodiment of the present invention including an array of products supported in a band which is inserted into a package housing shown in its preassembled condition.

FIGS. 12, 13 and 14 show further details of the package of FIG. 11.

DETAILED DESCRIPTION OF THE PREFERRED EMBODIMENTS

The present invention is directed to a package assembly which contains a plurality of consumable products in a package housing. The package housing is openable to allow dispensing of one or more products therefrom and is reclosable to contain and maintain the products therein. While the present invention is useful with a wide of variety of consumable product, it is particularly useful with respect to elongate gum slabs which are arranged in a side-by-side array.

Consumable product packages of this type are disclosed in commonly assigned U.S. patent application Ser. No. 10/833,468 filed Jul. 1, 2004 entitled "Confectionery Packaging Design" and Ser. No. 11/025,739 filed Dec. 22, 2004 entitled "Gum Package Design with Two Separate Compartments", both of which are incorporated by reference herein for all purposes.

Moreover, the present invention discloses consumable product packages of the type shown in commonly assigned U.S. patent application Ser. No. 11/124,926, filed at even date herewith entitled "Gum Slab Package Having Insertable Product Retention Member" now U.S. Pat. No. 7,811,614, and also shown in commonly assigned U.S. patent application Ser. No. 11/124/922, filed at even date herewith entitled "Package For Dispensing And Retaining Gum Slabs With Adhesive Securement" now U.S. Pat. No. 7,625,686, both of which are incorporated by reference herein for all purposes.

Figure 1:
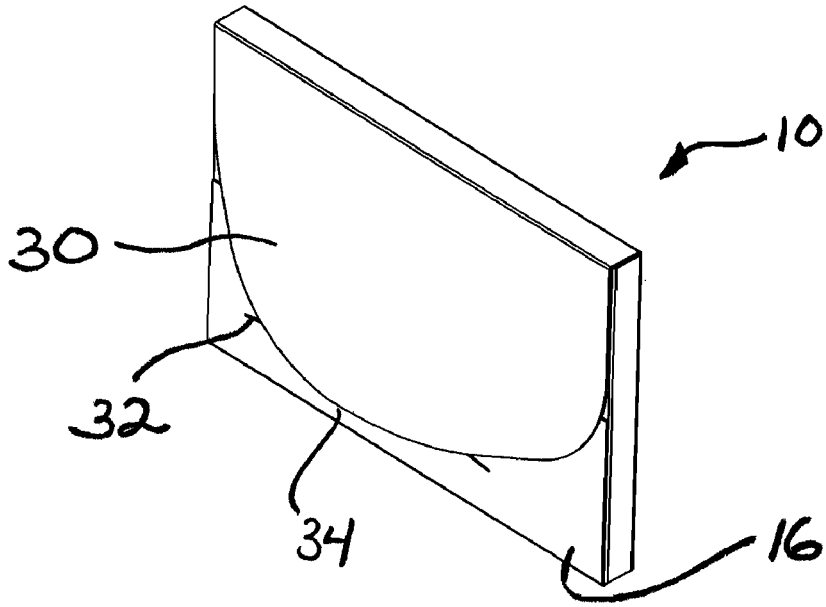
FIG. 1 is a perspective showing of the package assembly of the present invention in a closed condition.
Figure 2:
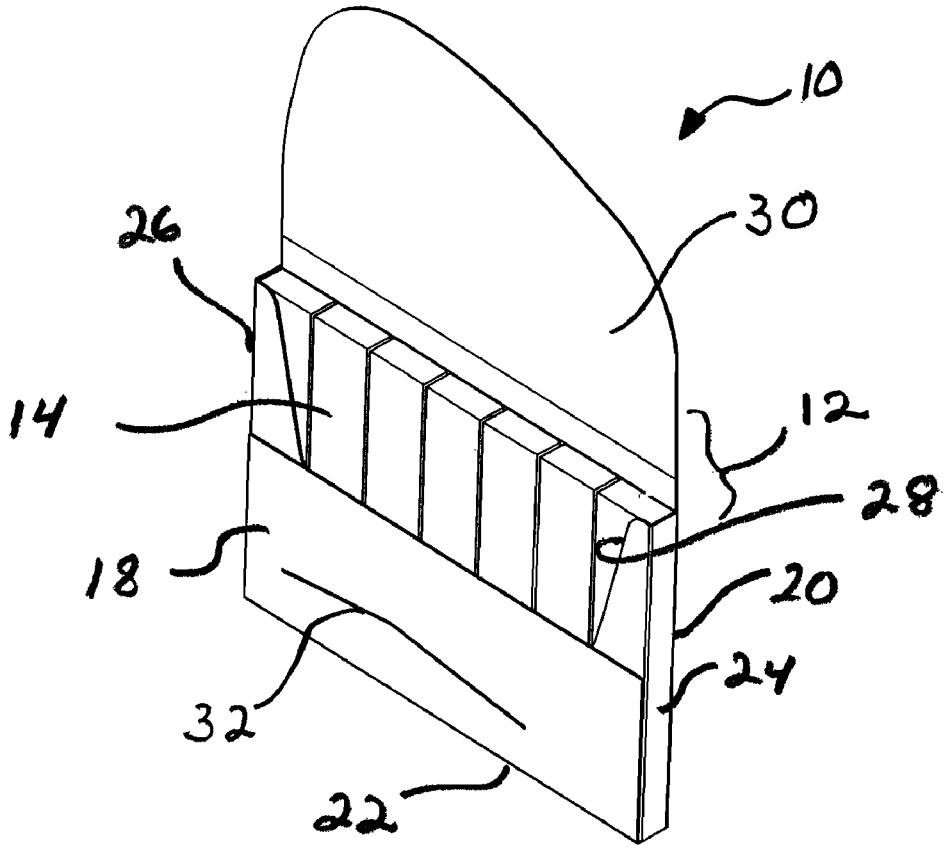
FIG. 2 is a perspective showing of the package assembly of FIG. 1 in an opened condition showing an array of products which may be dispensed from a dispensing opening.

Referring now to FIGS. 1 and 2, the present invention provides a packaging assembly 10 which includes an array 12 of gum slabs 14. Gum slabs 14 are typically elongate rectangularly shaped members which may optionally include wrappers (not shown in FIG. 2) individually around each gum slab. The gum slabs are arranged in a side-by-side fashion to form array 12. The gum slabs 14 are supported in the array in a package housing 16. The package housing 16 includes a front wall 18, an opposed back wall 20, a bottom wall 22, and opposed side walls 24 and 26. As will be described in further detail hereinbelow, the package housing is formed from die cut paperboard, which is folded in a well known manner to form the configuration shown in FIGS. 1 and 2. The package housing 16 is folded such that it provides an open upper end 28 which defines a dispensing opening. The back wall 20 includes an upwardly extending foldable cover 30 which may be folded over the open upper end to close the opening and contain the slabs 14 within the package housing 16. A slit 32 positioned in the front wall 18 allows the distal edge 34 of cover 30 to be inserted therein for reclosing purposes. Additionally, it is contemplated that the package is provided in the condition shown in FIG. 1 with the cover 30 adhesively secured to the front wall 18. Once the adhesive securement is removed to dispense the first gum slab, the cover 30 may be reclosed by inserting it into the slit 32.

It is also contemplated that the package housing 16 may be covered by a plastic wrap (not shown) which encloses and protects the package and during shipping and prior to sale and use.

As will be described in further detail hereinbelow, it is contemplated that the array 12 of slabs 14 will be removable retentively supported within the package housing 16 so that it permits easy removal of one or more gum slabs while maintaining the remainder of the gum slabs in the package housing. Furthermore, it is contemplated that the technique for releasably supporting the slabs 14 within the package housing will permit the slabs 14 to maintain their position within the housing even after removal of one or more of the adjacent gum slabs so as to prevent the gum slabs from tilting or falling over in the package or falling out from the package.

Referring now to FIGS. 3-6, one embodiment of the present invention is shown. With respect to the present embodiment, similar reference numerals denote similar elements with 100 added to the reference numerals of FIGS. 1 and 2 to denote the present embodiment.

FIG. 3 shows the package assembly 110 with the package housing 116 in its preassembled condition. The package housing 116 is formed from a die cut paperboard form which may be folded from its flat configuration shown in FIG. 3, into the configuration shown in FIGS. 1 and 2. The package housing includes a back wall 120, a foldable front wall 118, foldable side walls 124 and 126 and a foldable cover 130. The package housing 116 supports an array 112 of gum slabs 114 against the interior surface of back wall 120.

In the present illustrative embodiment, gum slabs 114 are unwrapped gum slabs including a scored transverse groove 125 extending in aligned fashion therealong. As will be described in further detail hereinbelow, the groove 125 is optionally provided in the present embodiment.

The front wall 118 of package housing 116 includes a foldable flap 119 extending distally therefrom. When the package housing 116 is folded into its package configuration, the foldable flap 119 is folded inwardly toward the gum slabs 114 along fold line 121.

Referring now FIGS. 4-6, where the cover 130 is not shown for clarity, the foldable flap 119 is folded inwardly towards back wall 120 upon folding, forming thereby the front wall 118. A distal edge 123 of foldable flap 119 engages the slabs 114 of array 112. The transverse length of foldable flap 119 is such that it spans and extends across each of the gum slabs 114 of array 112. The foldable flap 119 exerts, in its closed position as shown in FIGS. 5 and 6, a spring bias or pressure against the slabs 114. Such a spring bias is sufficient, when the package housing is assembled, to frictionally retain the slabs 114 in package housing 116.

Such bias provided by the foldable flap 119 is sufficient to maintain the gum slabs in the package in a releasable fashion. Thus, one or more of the gum slabs may be removed from the package housing 116 against the bias provided by the foldable flap 119. However, after removal of one or more of the gum slabs, the remaining gum slabs will be retentively supported within the package housing 116 and will be maintained in the upright position notwithstanding the fact that an adjacent gum slab has been removed.

As mentioned hereinabove, the array 112 of gum slabs 114 may include a scored transverse groove 125 extending in aligned fashion thereacross. It is contemplated that the distal edge 123 of foldable flap 119 may be engaged within the scored groove 125 so as provide additional retention of the gum slabs 114 within the package housing 116. Thus, in order to remove the gum slabs individually from the package housing, the positioning of the distal edge 123 of flap 119 within groove 125 must be overcome.

The scored groove 125 also helps to positionally confine the slabs 114 and maintain the slabs 114 in an upright condition, even after removal of an adjacent slab.

Referring now to FIGS. 7-10, a further embodiment of the present invention is shown. With respect to the present embodiment, similar reference numerals denote similar elements with 200 being added to the reference numerals of FIGS. 1 and 2 to denote the present embodiment.

FIG. 7 shows the package assembly 210 with the package housing 216 in its preassembled condition. The package housing 216 is formed from a die cut paperboard form which may be folded from its flat configuration shown in FIG. 7, into the configuration shown in FIGS. 1 and 2. The package housing includes a back wall 220, a foldable front wall 218, foldable side walls 224 and 226 and a foldable cover 230. The package housing 216 supports an array 212 of gum slabs 214 against the interior surface of back wall 220.

In the present illustrative embodiment, gum slabs 214 are wrapped gum slabs. Each gum slab 214 may be individually wrapped with a paper and/or foil wrapper 215 in conventional fashion. Wrapping in this manner provides a folded wrapper flap 217 at each end thereof. In the present embodiment, the wrapper flaps 217 are folded on the same side of the gum slab and are mutually inwardly facing. The array 214 of gum slabs are arranged such that the wrapper flaps face the front wall 218 when the package housing is assembled.

The front wall 218 of package housing 216 includes a foldable wall flap 219 extending distally therefrom. When the package housing 216 is folded into its package configuration, the foldable flap 219 is folded inwardly towards the gum slabs 214 along fold line 221.

Referring now to FIGS. 8-10 where the cover 230 is not shown for clarity, the foldable flap 219 is folded inwardly with respect to the back wall 220 upon folding, foaming thereby the front wall 218. A distal edge 223 of foldable flap 219 engages the slabs 214 of array 212. The transverse length of foldable flap 219 is such that it spans and extends across each of the wrapped gum slabs 214 of array 212. The foldable flap 219 exerts, in its closed position as shown in FIGS. 8 and 9, a spring bias of pressure against the wrapped slabs 214. Such a spring bias is sufficient, when the package housing is assembled, to frictionally retain the slabs 214 in package housing 216. Such bias provided by the foldable flap 219 is sufficient to maintain the gum slabs in the package in releasable fashion. In that regard, the bias provided by the foldable flap 219 is such that although the slabs 214 are shown in position within package housing 216 where the wrapper flaps 217 face towards the front wall 218, the wrapped gum slabs 214 may be arranged in an oppositely facing fashion with the folded wrapper flaps 217 facing against the back wall 220.

As may be appreciated, once the package housing 216 is assembled, the distal edge 223 of foldable flap 219 bears against the wrapped gum slabs 214 just above the location of the folded wrapper flaps 217. In addition to the frictional spring bias retention of the wrapped gum slabs 214 provided by the foldable flap 219, in an attempt to remove one of the wrapped gum slabs 214 from the array, the folded wrapper flap 217 will catch on the distal edge 223 of foldable wall flap 219. This will also serve to retentively hold the gum slabs within the package 216. Since the wrapper flap 217 is folded, upon manual removal of an individual gum slab 214 therefrom the wrapper 217 will unfold allowing complete removal from package 216. However, the engagement between the folded wrapper flap 217 and the distal edge 223 of foldable flap 219 is sufficient to maintain the individual gum slabs within the package preventing inadvertent dislodgement therefrom even where adjacent gum slabs have been previously removed. Thus, after removal of one or more gum slabs from the package housing 216, the remaining gum slabs will be retentively supported within the package housing 216 by the bias provided by the foldable flap 219 and also will be retentively held therein by engagement between the distal edge 223 and the wrapper flap 217.

Referring now to FIGS. 11-14, a still further embodiment of present invention is shown. With respect to the present embodiment, similar reference numerals denote similar elements with 300 added to the reference numerals of FIGS. 1 and 2 to denote the present embodiment.

FIG. 11 shows the package assembly 310 with the package housing 316 in its preassembled condition. The package housing 316 is formed from a die cut paperboard form which may be folded from its flat configuration shown in FIG. 11 into the configuration shown in FIGS. 1 and 2. The package housing includes a back wall 320, a foldable front wall 318, foldable side walls 324 and 326 and a foldable cover 330. The package housing 316 supports an array 312 of gum slabs 314 against the interior surface of back wall 320. In the present illustrative embodiment, gum slabs 314 may be wrapped or unwrapped gum slabs.

The gum slabs are further contained within a band 331. Band 331 may be formed of a wide variety of materials including paper, foil or combinations thereof.

In the present illustrative embodiment, the band is formed into a pouch or U-shaped configuration having opposed front and back walls, side walls, and a bottom wall. The array 312 of gum slabs 314 is positioned within the band with the aligned lower ends thereof contained within the U-shaped band. While a U-shaped band is shown herein, other configurations of the band may be employed. Band 331 defines an upper distal edge 333 beyond which the gum slabs 314 extend.

The front wall 318 of package housing 316 includes a foldable flap 319 extending distally therefrom. When the package housing 316 is folded into its package configuration, the foldable flap 319 is folded inwardly towards the gum slabs along fold line 321.

Referring now to FIGS. 12-14 where the cover 330 is shown removed for clarity, the foldable flap 319 is folded inwardly towards the back wall 320 upon folding, forming thereby the front wall 318 for retaining the array of products within the package. The transverse length of the foldable flap 319 may be such that a distal edge 323 extends across 314 of the array 312. Thus, as described above, the foldable flap 319 may exert in its closed position, as shown in FIGS. 13 and 14, a spring bias of pressure against the slabs 314. Such a spring bias is sufficient when the package housing is assembled to frictionally retain the slabs 314 in the package housing 316.

Moreover, the distal edge 323 of the inwardly foldable flap 319 may overlap with the transverse edge 333 of band 331 thereby residing between the slabs 312 and the band 331. Such overlapping prevents the band from being removed from the package. In this manner, the gum slabs retained within the band 331 are thereby retained within the package housing 316. It is contemplated that, optionally, a releasable adhesive may be employed to removably secure the individual gum slabs within the band 331. Wax or other known adhesives may be employed. Thus, one or more gum slabs may be removed from the package housing 316 against the bias provided by the foldable flap 319. After such removal of one or more of the gum slabs, the remaining gum slabs will be retentively supported within the package housing and will be maintained in an upright position. Moreover, the band 331 itself is maintained within the package housing 316 by the engagement between the transverse edge 333 of band 331 and the edge 323 of inwardly folded flap 319 thus further retaining the products within the package housing 316.

Having described the preferred embodiments herein, it should now be appreciated that variations may be made thereto without departing from the contemplated scope of the invention. Accordingly, the preferred embodiments described herein are deemed illustrative rather than limiting, the true scope of the invention being set forth in the claims appended hereto.

What is claimed is:

1. A package assembly for individual elongate consumable products comprising:

a plurality of said products having opposed ends, said products being aligned in a side-by-side array;

a package housing for enclosing said array of products, said package housing having a front wall, a back wall, opposite side walls and a bottom wall, said side walls and said back wall attaching said front wall and said back wall together at said front wall and said back wall peripheral edges for supporting said products therebetween and a closeable cover for closing a product dispensing opening;

wherein said front wall further comprises a foldable wall flap extending inwardly toward said back wall for frictional engagement with said array of products between the ends thereof for removable retention of said products therein;

wherein said wall flap has a distal edge engagable across said array of side-by-side products;

said foldable wall flap being folded to provide a resilient inward bias thereby providing said frictional engagement of said products therein;

wherein each of said products of said array includes a wrapper, said wrapper being folded at least one end so as to define an upwardly turned wrapper flap facing said wall flap, said wrapper flap being positioned below said distal edge of said wall flap to engage said wall flap upon withdrawal of end of said products from said package housing to thereby provide releasable retentive support said products in said package housing.

2. A package assembly of claim 1 wherein said upwardly formed wrapper flap is deflectable so as to permit removal of said product from said housing.

* * * * *

UNITED STATES PATENT AND TRADEMARK OFFICE

CERTIFICATE OF CORRECTION

PATENT NO. : 8,252,352 B2
APPLICATION NO. : 13/039435
DATED : August 28, 2012
INVENTOR(S) : Allen Sydney Aldridge It is certified that error appears in the above-identified patent and that said Letters Patent is hereby corrected as shown below:

At column 3, line 24, the printed patent reads "...Ser. No. 11/124,926, filed..."; the patent should read instead as --...Ser. No. 11/124,906, filed...--.

At column 3, line 30, the printed patent reads "...U.S. Patent No. 7,625,686, both of which..."; the patent should read instead as --...U.S. Patent No. 7,325,686, both of which...--.

Signed and Sealed this
Twentieth Day of November, 2012

David J. Kappos

David J. Kappos
*Director of the United States Patent and Trademark Office*